United States Patent [19]

Child

[11] Patent Number: 4,812,430

[45] Date of Patent: Mar. 14, 1989

[54] $NO_x$ CONTROL DURING MULTISTAGE COMBUSTION

[75] Inventor: Jonathan E. Child, Sewell, N.J.

[73] Assignee: Mobil Oil Corporation, New York, N.Y.

[21] Appl. No.: 84,242

[22] Filed: Aug. 12, 1987

[51] Int. Cl.[4] ..... B01J 38/36; B01J 29/38; C10G 11/18; C01B 21/20

[52] U.S. Cl. ..... 502/42; 208/113; 208/120; 208/164; 423/235; 502/21; 502/41

[58] Field of Search ..... 502/42, 21, 41, 515; 208/164

[56] References Cited

U.S. PATENT DOCUMENTS

| | | | |
|---|---|---|---|
| 3,808,121 | 4/1974 | Wilson, Jr. | 208/113 |
| 3,893,812 | 7/1975 | Conner et al. | 208/164 |
| 3,970,587 | 7/1976 | Shinnaret al. | 208/164 |
| 4,093,535 | 6/1978 | Schwartz | 502/42 |
| 4,151,121 | 4/1979 | Gladrow | 502/65 |
| 4,181,600 | 1/1980 | Chester | 502/42 |
| 4,197,189 | 4/1980 | Thompson et al. | 208/164 |
| 4,199,435 | 4/1980 | Chessmore et al. | 208/113 |
| 4,204,944 | 5/1980 | Flanders et al. | 208/124 |
| 4,204,945 | 5/1980 | Flanders et al. | 208/124 |
| 4,235,704 | 11/1980 | Luckenbach | 208/120 |
| 4,283,273 | 8/1981 | Owen | 502/42 |
| 4,285,908 | 8/1981 | Thompson et al. | 420/144 |
| 4,290,878 | 9/1981 | Blaton, Jr. | 502/42 |
| 4,300,997 | 11/1981 | Meguerian et al. | 208/120 |
| 4,309,309 | 1/1982 | Blanton, Jr. | 208/164 |
| 4,313,848 | 2/1982 | Scott | 208/164 |
| 4,325,833 | 4/1982 | Scott | 208/148 |
| 4,340,566 | 7/1982 | Thompson et al. | 422/144 |
| 4,350,615 | 9/1982 | Meguerian et al. | 252/455 Z |
| 4,356,082 | 10/1982 | Gross | 208/164 |
| 4,430,201 | 2/1984 | Castagnos, Jr. et al. | 208/164 |
| 4,541,921 | 9/1985 | Gross et al. | 208/164 |
| 4,542,114 | 9/1985 | Hegarty | 502/42 |

OTHER PUBLICATIONS

Lexpat Search (35 Pats. Found & Summarized in search report).

*Primary Examiner*—Paul E. Konopka
*Attorney, Agent, or Firm*—Alexander J. McKillop; Charles J. Speciale; Richard D. Stone

[57] ABSTRACT

An FCC regenerator comprising a first dense bed coke combuster, a dilute phase transport riser, and a second dense bed operates with selective addition of CO combustion catalyst downstream of the coke combustor and preferably into the dilute phase transport riser. The process and apparatus permits maintenance of a reducing atmosphere in the first dense bed, which promotes conversion of $NO_x$ compounds to nitrogen within the FCC regenerator. Coke can be burned in the first dense bed, the transport riser, or the second dense bed, so that the average catalyst temperature and steaming severity is reduced.

12 Claims, 3 Drawing Sheets

$NO_x$ CONTROL DURING MULTISTAGE COMBUSTION

BACKGROUND OF THE INVENTION

1. Field of the Invention

The invention relates to a method and apparatus for controlling nitrogen oxide emissions from flue gases generated during multiple stage fluidized bed combustion, and especially during regeneration of spend FCC catalyst.

2. Description of the Prior Art

Catalytic cracking of hydrocarbons is carried out in the absence of externally supplied $H_2$, in contrast to hydrocracking, in which $H_2$ is added during the cracking step. An inventory of particulate catalyst is continuously cycled between a cracking reactor and a catalyst regenerator. In the fluidized catalyst cracking (FCC) process, hydrocarbon feed contacts catalyst in reactor at 425° C.–600° C., usually 460° C.–560° C. The hydrocarbons crack, and deposit some carbonaceous coke on the catalyst. The cracked products are separated from the coked catalyst. The coked catalyst is stripped of volatiles, usually with steam, and is then regenerated. In the catalyst regenerator, the coke is burned from the catalyst with oxygen containing gas, usually air. Coke burns off restoring catalyst activity and simultaneously heating the catalyst to, e.g., 500° C.–900° C., usually 600° C.–750° C. Flue gas formed by burning coke in the regenerator may be treated for removal of particulates and for conversion of carbon monoxide, after which the flue gas is normally discharged into the atmosphere.

Most FCc units now use zeolite-containing catalyst having high activity and selectivity. These catalysts work best when the amount of coke on the catalyst after regeneration is relatively low. It is desirable to regenerate zeolite catalyst to as low as residual carbon level as is possible. It is also desirable to burn CO completely within the catalyst regenerator system to conserve heat and to minimize air pollution. Heat conservation is especially important when the concentration of coke on the spent catalyst is relatively low as a result of high catalyst selectivity. Among the ways suggested to decrease the amount of carbon on regenerated catalyst and to burn CO in the regenerator is to add a CO combustion promoter metal in the catalyst or to the regenerator. Metals have been added as an integral component of the cracking catalyst and as a component of a discrete particulate additive, in which the active metal is associated with a support other than the catalyst.

U.S. Pat. No. 2,647,860 proposed adding 0.1–1 weight percent chromic oxide to a cracking catalyst to promote combustion of CO. U.S. Pat. No. 3,808,121, incorporated herein by reference, introduced relatively large-sized particles containing CO combustion-promoting metal into a cracking catalyst regenerator. The small-sized catalyst particles cycle between the cracking reactor and the catalyst regenerator. The large size combustion-promoting particles remain in the regenerator. Oxidation-promoting metals such as cobalt, copper, nickel, manganese, copper-chromite, etc., impregnated on an inorganic oxide such as alumina, are disclosed.

U.S. Pat. Nos. 4,072,600 and 4,093,535, both incorporated by reference, teach use of combustion-promoting metals such as Pt, Pd, Ir, Rh, Os, Ru and Re in cracking catalysts in concentrations of 0.01 to 50 ppm, based on total catalyst inventory.

Some cracking operations using CO combustion promoters generate nitrogen oxides ($NO_x$) in the regenerator flue gas. It is very difficult in a catalyst regeneration system to completely burn coke and CO in the regenerator without increasing the $NO_x$ content of the regenerator flue gas.

Although many refiners have recognized the problem of $NO_x$ emissions from FCC regenerators, the solutions proposed have not been completely satisfactory. The approaches taken so far have generally been directed to special catalysts which inhibit the formation of $NO_x$ in the FCC regenerator, or to process changes which reduce $NO_x$ emissions from the regenerator.

Recent catalyst patents include U.S. Pat. No. 4,300,997 and its division U.S. Pat. No. 4,350,615, both directed to the use of Pd-Ru CO-combustion promoter, The bi-metallic CO combustion promoter is reported to do an adequate job of converting CO to $CO_2$; while minimizing the formation of $NO_x$.

Another catalyst development is disclosed in U.S. Pat. No. 4,199,435 which suggests steam treating conventional metallic CO combustion promoter to decrease $NO_x$ formation without impairing too much the CO combustion activity of the promoter.

Process modifications are suggested in U.S. Pat. Nos. 4,413,573 and 4,325,833 directed to two-and three-stage FCC regenerators, which reduce $NO_x$ emissions.

U.S. Pat. No. 4,313,848 teaches countercurrent regeneration of spent FCC catalyst, without backmixing, to minimize $NO_x$ emissions.

U.S. Pat. No. 4,309,309 teaches the addition of a vaporizable fuel to the upper portion of a FCC regenerator to minimize $NO_x$ emissions. Oxides of nitrogen formed in the lower portion of the regenerator are reduced in the reducing atmosphere generated by burning fuel in the upper portion of the regenerator.

U.S. Pat. No. 4,235,704 suggests too much CO combustion promoter causes $NO_x$ formation, and calls for monitoring the $NO_x$ content of the flue gases, and adjusting the concentration of CO combustion promoter in the regenerator based on the amount of $NO_x$ in the flue gas.

The approach taken in U.S. Pat. No. 4,542,114 is to minimize the volume of flue gas by using oxygen rather than air in the FCC regenerator, with consequent reduction in the amount of flue gas produced.

The FCC regenerators shown in U.S. Pat. Nos. 3,893,812 and 4,197,189 are staged regenerators, which emit less $NO_x$ than FCC regenerators using a single dense bed for catalyst regeneration. It is a good regenerator, but still can produce too much $NO_x$.

All the catalyst and process patents discussed above from U.S. Pat. Nos. 4,300,997 to 4,197,189, are incorporated herein by reference.

In addition to the above patents, there are myriad patents on treatment of flue gases containing $NO_x$. The flue gas might originate from FCC units, or other units. U.S. Pat. Nos. 4,521,389 and 4,434,147 disclose adding $NH_3$ to $NO_x$ containing flue gas and catalystically reducing the $NO_x$ to nitrogen.

None of the approaches described above provides the perfect solution. Process approaches which reduce $NO_x$ emissions require extensive rebuilding of the FCC regenerator.

Various catalytic approaches, eg. use of bi-metallic CO combustion promoters, provide some assistance, but the cost and complexity of a bi-metallic combustion promoter is necessary. The reduction in $NO_x$ emissions achieved by catalytic approaches helps some but still may fail to meet the ever more stringent $NO_x$ emissions limits set by local governing bodies. Much of the $NO_x$ formed is not the result of combustion of $N_2$ within the FCC regenerator, but rather combustion of nitrogen-containing compounds in the coke entering the FCC regenerator. Bi-metallic combustion promoters are probably best at minimizing $NO_x$ formation from $N_2$.

I have discovered a way to overcome most of the deficiencies of the prior art methods of reducing $NO_x$ emissions from a multistage FCC regenerator. The regenerators of special interest are the "minimum inventory" FCC regenerators which have a dense bed coke combustor, a dilute phase transport riser above the dense bed, and a second dense bed which holds hot, regenerated catalyst for recycle to the FCC reactor and also preferably, to the combustor.

I use conventional CO combustion promoter metals in an unconventional way. By selectively adding most of the CO combustion promoter to the transport riser, or to the top of the second regenerator dense bed I achieved a significant reduction in $NO_x$ emissions while still achieving satisfactory CO combustion. The approach was, in a sense, to turn the teaching of U.S. Pat. No. 3,808,121 upside down. The '121 patent added large-sized particles containing a CO combustion-promoting metal into an FCC regenerator. These particles because of their size and weight congregated at the bottom of the FCC regenerator dense bed. Withdrawal of hot regenerated catalyst occurred from an upper level of the FCC regenerator dense bed, so only the small-sized FCC catalyst cycled back and forth between the reactor.

In my process it is irrelevant whether or not the CO combustion promoter enters the cracking reactor, while it is essential that most coke combustion occur in a reducing atmosphere, with afterburning of CO to $CO_2$ completed later. Preferably, most afterburning occurs in the dilute phase transport riser or in the upper portion of the second dense bed.

SUMMARY OF THE INVENTION

Accordingly, the present invention provides a fluidized cracking process wherein conventional FCC catalyst contacts conventional FCC feedstocks in a conventional FCC reactor to produce cracked products and coked catalyst which is discharged into a first dense bed coke combustor to which air or an oxygen-containing gas is added to produce at least partially regenerated catalyst and combustion gas which rise from the first dense bed and through a dilute phase transport riser to form a second dense bed of regenerated catalyst and flue gas, and the regenerated catalyst is recycled to the FCC reactor, the improvement comprising selective addition of a CO combustion promoter to the dilute phase transport riser so that there is a greater concentration of CO combustion promoter in the dilute phase transport riser than in the first dense bed.

FCC FEED STOCK

Figure 1:
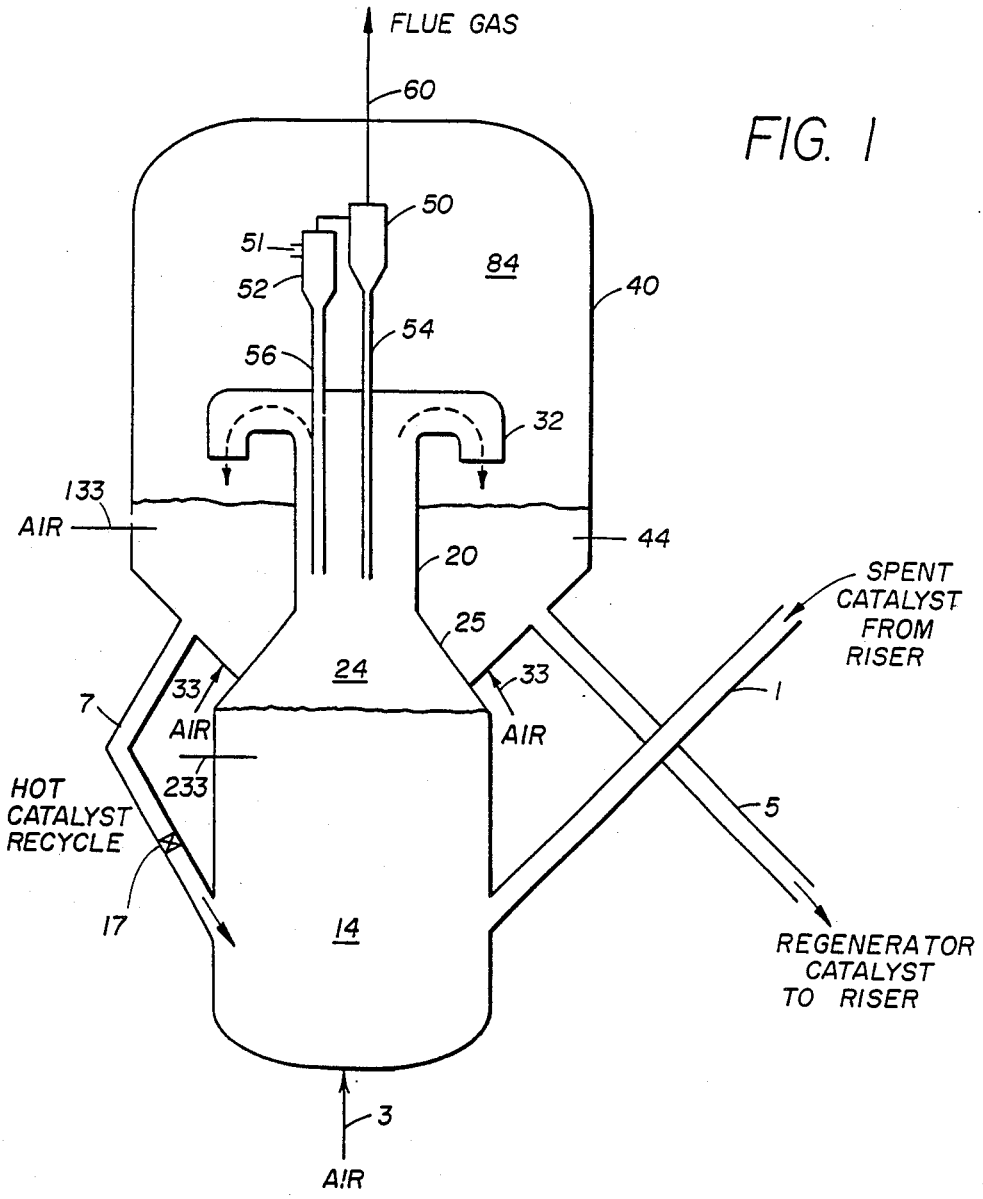
FIG. 1 is a simplified representation of one embodiment of a regenerator of the present invention.

Any conventional FCC feed stock can be used. The process of the present invention also makes it possible to use charge stocks which are relatively high in nitrogen content, and which otherwise might result in unacceptable $NO_x$ emissions in conventional FCC units. The feed stocks may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

FCC CATALYST

Any conventional FCC catalyst may be used. The catalyst can be 100% amorphous, but preferably includes some zeolite in a porous refractory matrix such as silica-alumina, clay, or the like. The zeolite is usually 5–35 wt. % of the catalyst, with the rest being matrix. Conventional zeolites include X and Y zeolites, with ultrastable, or relatively high silica Y zeolites being preferred. Dealuminized Y (DEAL Y) and ultrahydrophobic Y (UHP Y) zeolite may be used. The catalyst may also contain one or more shape selective zeolites, i.e., those having a Constraint Index of 1–12, and typified by ZSM-5, and other materials having a similar crystal structure.

Relatively high silica zeolite based catalyst are preferred for use in the present invention. They withstand the high temperatures usually associated with complete combustion of CO to $CO_2$ within the FCC regenerator.

The FCC catalyst composition, per se, forms no part of the present invention.

FCC REACTOR CONDITIONS

Conventional FCC reactor conditions may be used. These conditions include catalyst/oil weight ratios of 0.5:1 to 15:1 and preferably 3:1 to 8:1, and a catalyst/oil contact time of 0.5–50 seconds, and preferably 1–20 seconds.

The FCC reactor conditions, per se, are conventional and form no part of the present invention.

MINIMUM INVENTORY FCC REGENERATOR

The starting point of the present invention is a minimum inventory FCC regeneratory such as the disclosed in U.S. Pat. Nos. 3,893,812 or 4,197,189.

In such a design, spent catalyst from an FCC reactor is discharged into a first dense bed. As this regenerator design has several dense beds, the first one is sometimes called a coke combustor, which is a convenient way of labeling the first dense bed by it primary function. Air or other oxygen containing regeneration gas is added, at least partially burning the coke from the catalyst. This coke combustion generates CO, $CO_2$ and at least partially regenerated catalyst. The CO, $CO_2$ and partially regenerated catalyst are transported through a dilute phase transport riser where additional CO combustion may occur. Regenerated catalyst, and flue gases containing $CO_2$ and very little CO, are discharged from the dilute phase transport riser. The regenerated catalyst collects in a second dense bed. Hot regenerated catalyst is recycled to the FCC reactor, although a portion of this hot regenerated catalyst may be recycled to the coke combustor.

These minimum inventory regenerators, so called because they operate with a relatively low inventory of FCC catalyst as compared to earlier designs using only a single dense bed, are good designs for minimizing $NO_x$ emissions. The reasons for the reduced emissions of $NO_x$ from such FCC regenerators is not totally understood, but it is probably due in part to combustion of coke in the generally reducing atmosphere in the coke combustor. The reducing atmosphere is the coke combustor promotes reduction of $NO_x$ to nitrogen. Although the minimum inventory, two dense bed regenerator design is better regards $NO_x$ emissions, there are still some feedstocks containing large amounts of nitrogen, or environmental restrictions, which make further reductions in $NO_x$ emissions desirable.

CO COMBUSTION PROMOTER

Use of a CO combustion promoter is essential for the practice of the present invention, however, these materials are well-known.

U.S. Pat. Nos. 4,072,600 and 4,235,754, the contents of which have been incorporated by reference, disclose operation of an FCC regenerator with minute quantities of a CO combustion promoter. From 0.01 to 50 ppm Pt metal or enough other metal to give the same CO oxidation, may be used with good results.

Very good results are obtained in the "minimum inventory" FCC regenerators with as little as 0.1 to 5 wt. ppm platinum present on the catalyst. Pt can be replaced by other metals, but usually more metal is then required. An amount of promoter which would give a CO oxidation activity equal to 0.3 to 3 wt. ppm of platinum is preferred.

Conventionally, refiners add CO combustion promoter to promote total or partial combustion of CO to $CO_2$ within the FCC regenerator. More CO combustion promoter can be added without undue bad effect-the primary one being the waste of adding more CO combustion promoter than is needed to burn all the CO.

Preferably, the CO combustion promoter is on a support which is readily segregable from the conventional FCC catalyst. Thus, in one embodiment of the present invention, the CO combustion promoter is on a material with about the same density as the FCC catalyst, but of a smaller particle size than the FCC catalyst, so that it tend to congregate in the upper portion of the FCC regenerator beds.

It is also possible, and preferred, to use Pt (or other CO combustion promoter metal) rich additive on particles as large as or larger than the conventional FCC catalyst. The Pt-rich additive should then have a lower density than the conventional FCC catalyst or be supported by mechanical means in the upper portion of the FCC regenerator dense beds.

A possible mechanical approach is to physically implant the CO combustion promoter within the upper portion of the dense bed of the FCC regenerator. Platinum wires, platinum impregnated honeycombs or rods, could be placed in the upper portion of the FCC regenerator dense bed. Great care should be taken to ensure that such permanently implanted devices do not impair good fluidization within the FCC regenerator. The devices should also be sturdy enough to survive months and even years of operation within the severe erosive environment of an FCC regenerator.

The Pt-rich additive may also be in the form of very large particles which are hollow, such as alumina ping pong balls impregnated with platinum. These exotic CO combustion catalysts would be easy to segregate within the upper portion of the FCC regenerator dense beds, but such an approach may involve extra costs for the unusual support materials. When large particles are used as as support for the CO combustion promoter, the particles are preferably at least 10 times larger in diameter than the average catalyst diameter. When ½" diameter particles, with a bulk density of 0.65 g/cc, are used they float on top of a dense phase fluidized bed of FCC catalyst.

FCC REGENERATOR CONDITIONS

The temperatures, pressures, oxygen flow rates, etc., are within the broad ranges of those heretofore found suitable for FCC regenerators, especially those operating with substantially complete combustion of CO to $CO_2$ within the regeneration zone. In the prior art, suitable and preferred operating conditions in the coke combustor, transport riser, and second dense bed and dilute phase above second dense bed are summarized in Table I below.

TABLE I

PRIOR ART REGENERATOR CONDITIONS

| | Broad | Preferred | Most Preferred |
|---|---|---|---|
| First Dense Bed | | | |
| Temperature °C. | 590–925 | 650–760 | 660–730 |
| Density #/FT$^3$ | 10–50 | 15–40 | 25–30 |
| Cat. Residence Time, sec | 20–350 | 30–150 | 40–100 |
| Pressure, atm | 1–10 | 2–5 | 3–4.5 |
| % Stoichiometric $O_2$ Added here | 100–150 | 100–110 | 100–105 |
| Transport Riser | | | |
| Temperature °C. | 590–925 | 650–760 | 660–730 |
| Density #/FT$^3$ | 0.5–10 | 1–5 | 2–4 |
| Cat. Residence Time, sec | 5–100 | 10–60 | 20–40 |
| Pressure, atm | 1–10 | 2–5 | 3–4.5 |
| % Stoichiometric $O_2$ Added here | 0 | 0 | 0 |
| Second Dense Bed | | | |
| Temperature °C. | 590–925 | 650–760 | 660–730 |
| Density #/FT$^3$ | 10–60 | 20–50 | 25–40 |
| Cat. Residence Time, sec | 10–350 | 20–150 | 20–100 |
| Pressure, atm | 1–10 | 2–5 | 3–4.5 |
| % Stoichiometric $O_2$ Added here | 1–50 | 1–30 | 1–10 |
| Dilute Phase Above Second Dense Bed | | | |
| Temperature °C. | 570–925 | 650–760 | 660–760 |
| Density #/FT$^3$ | 0.01–10 | 0.1–2 | 0.1–1 |
| Cat. Residence Time sec | 5–100 | 10–60 | 10–40 |
| Pressure, atm | 1–10 | 2–5 | 3–4.5 |
| % Stoichiometric $O_2$ Added here | 0 | 0 | 0 |

Temperatures recited above are average temperatures in the region measured. Usually there is a temperature increase going through a minimum inventory regenerator, with the lowest temperatures being where coked catalyst is added to the coke combustor. Intermediate, but higher temperatures are observed in the dilute phase transport riser, with the highest temperatures in the second dense bed.

Depending on the amount of hot regenerated catalyst recycled to the coke combustor, and on the amount of air addition and CO combustion promoter added, it is possible to burn essentially all of the carbon monoxide to $CO_2$ within the coke combustor. With relatively complete combustion of CO in the first dense bed, or coke combustor, not much temperature rise need be experienced in passing through the dilute phase transport riser, second dense bed or dilute phase above the second dense bed. Most units would not be run this way, with enough hot catalyst recirculation from the second dense bed to the coke combustor to burn all the coke upstream of the transport riser, but it represents on extreme way of operating the unit. Another extreme operation is with a very large temperature rise in the regenerator. This comes about when either coke combustion is incomplete within the combustor, or when significant afterburning occurs in the dilute phase transport riser. Insufficient air in the coke combustor, minimal or no recycle of hot regenerated catalyst to the coke combustor, and little or no CO combustion promoter all favor higher temperature rises within the regenerator. Temperature rises of up to about 100° C. in the transport riser, with further temperature rises in the dilute phase above the second dense bed (due to afterburning) are conceivable. This extreme temperature rise case is not preferred, but it represents an extreme temperature profile which can be seen or generated in such an FCC regenerator.

So far as I know, commercially these regenerators are operated with essentially all of the air addition being to the coke combustor or to the combustor and a riser-mixer upstream of the combustor. In general, FCC operators want to obtain very clean catalyst, because it gives better yields, so all the air that is added is usually added as soon as possible in FCC regenerators. Some of the patent literature shows air injection in various points downstream of the coke combustor, and even fuel injection downstream of the coke combustor, but invariably, commercial units operate with all of the air (or other oxidizing gas such as oxygen) added to the coke combustor.

Commercially, a small amount of fluidizing gas is added to the second dense bed to keep the catalyst fluffed or aerated. The gas used is usually air. The catalyst is hot, and some additional coke combustion will occur here, from a few percent up to perhaps 5 to 15% of total coke removal occurring in the second dense bed.

Typically, all of the air is added to the coke combustor, and none is added higher up in the unit. About 75–95% or more of the coke combustion will occur in the coke combustor, with the remainder occurring in the dilute phase transport riser. Although there is plenty of air around to completely burn $CO_2$ in the coke combustor, usually much of the CO combustion occurs in the dilute phase transport riser in a non-promoted unit. CO combustion can occur either in the dilute phase or in the coke combustor when CO combustion promoter is present. Usually enough CO combustion promoter is present so that by the time the catalyst leaves the transport riser all CO has been afterburned to $CO_2$.

The invention will now be described in more detail with reference to the two figures, after which the regenerator conditions used in the present invention will be discussed.

DETAILED DESCRIPTION

FIG. 1 is a simplified flow diagram of one embodiment of the present invention as incorporated in an FCC regenerator consisting of a coke combuster, a dilute phase transport riser and a second dense bed for collection of regenerated catalyst. CO combustion promoter concentrates in catalyst fines which are collected and recycled, via the cyclone and its dipleg, to the dilute phase transport riser.

Figure 2:
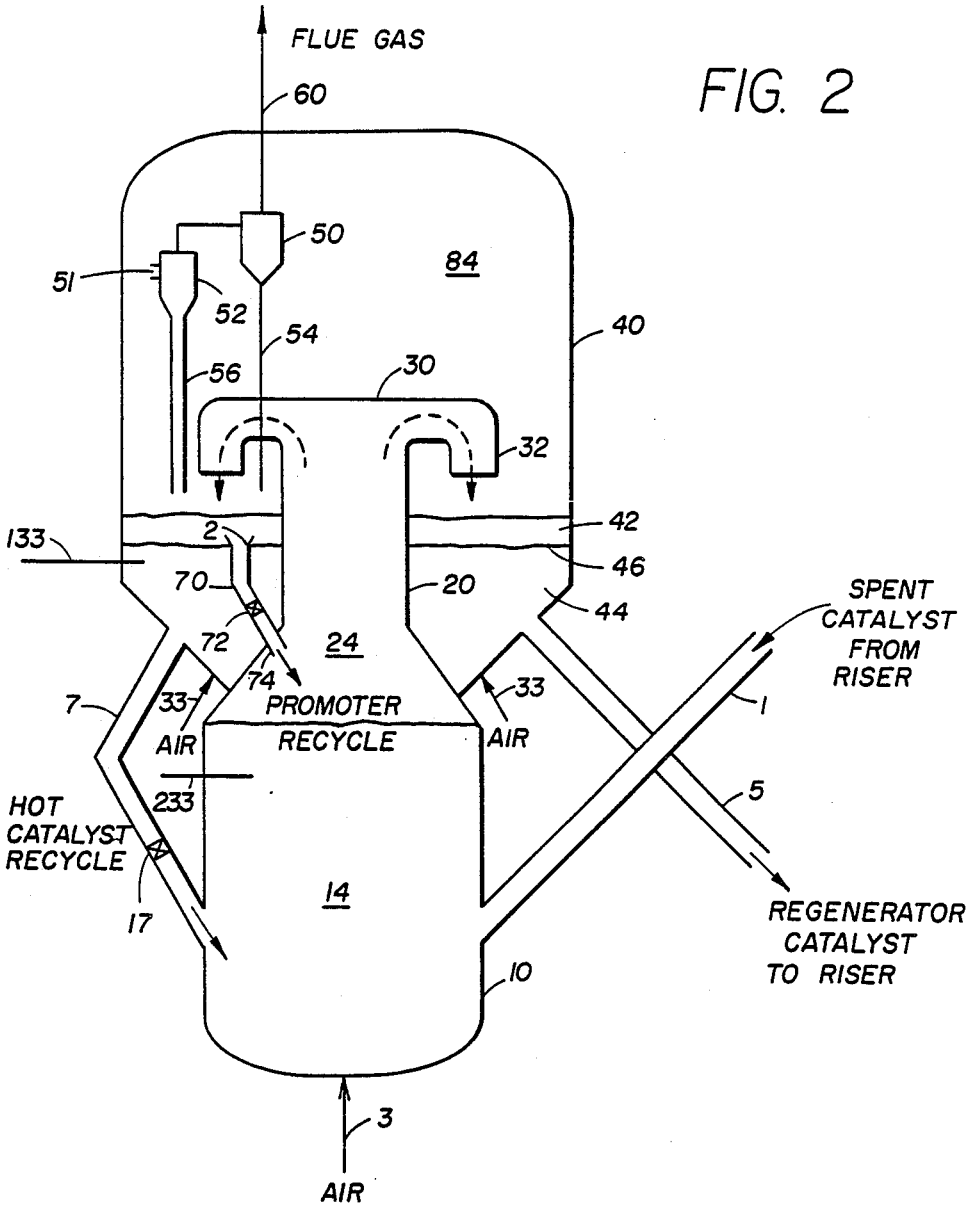
FIG. 2 is a simplified diagram of another embodiment of the present invention.

In FIG. 2, directed to a preferred embodiment, CO combustion promoter is preferentially added to the dilute phase transport riser. The CO combustion promoter is contained to a great extent on relatively large, low density, floating particles. Controlled lifting of the low density particles from the first dense bed or coke combustor to the second or outer dense bed containing hot regenerated catalyst may occur. The air velocity in the riser part of the regenerator may not be high enough to entrain many of the large particles. Each embodiment will be discussed in more detail below.

In FIG. 1, spent catalyst from an FCC reactor is charged via line 1 to a coke combustor 14. Combustor 14 contains a relatively dense bed of catalyst. Combustion air is added via line 3, while optional hot recycled catalyst is preferably added via line 17 and flow control means 17. Recycle of hot catalyst via line 7 is optional but preferred. Catalyst recycle acts as kindling to help light the fire in combustor 14 to promote rapid combustion of coke into carbon monoxide.

In lieu of, or as a supplement to, hot catalyst recycle via line 7 preheating of air or of spent catalyst in line 1 will increase the temperature in coke combuster 14 to promote rapid coke combustion.

Catalyst accumulates in combustor 14 and as it reaches the upper limits of combustor 14 catalyst enters the dilute phase transport riser 24. The narrowed cross-sectional area available for fluid low increases the vertical gas velocity, resulting in a transition from dense phase operation to dilute phase operation in the upper portion 20 of the transport riser. Traditionally most of the CO combustion to COhd 2, also known as afterburning, occurred in the dilute phase transport riser. Additional oxygen-containing gas, preferably air, may be added to dilute phase transport riser 24 by means not shown in the drawing. Addition of more air to the transport riser, and less to combustor 14, will promote CO after burning in the transport riser, and create a more reducing atmosphere in combustor 14.

In addition to air addition via lines 3 and 33, air may also be added via lines 133 and 233, as shown in FIG. 1.

Regenerated catalyst exits the transport riser via outlet 32 and is collected in a second dense bed 44. Hot regenerated catalyst is recycled to the FCC reactor via line 5 while another portion of hot regenerated catalyst is preferably recycled via line 7 to the combustor 14. Preferably, additional combustion air is added to the second dense bed via air inlets 33. The additional air helps remove the last traces of coke that may be on the catalyst, and also creates a more oxidizing atmosphere which promotes combustion of CO to $CO_2$.

Flue gas and catalyst fines are removed from the upper containment vessel 40 via two stages of cyclone separators which removed catalyst fines from flue gas. Flue gas enters primary cyclone 52 via inlet 51. Catalyst fines are discharged via dipleg 56 into transport riser 24. Exhaust gas from a primary cyclone 52 enters secondary cyclone 50, where additional catalyst fines are recovered and discharged via dipleg 54 into dilute phase transport riser 24. Flue gas, substantially free of catalyst fines and promoter, is removed via line 60.

Operating conditions in each portion of the regenerator are discussed in more detail hereafter.

In the present invention, in combustor 14, the operating conditions are

| | Suitable | Preferred | Most Preferred |
|---|---|---|---|
| Temperature °C. | 590 to 925 | 650 to 760 | 660 to 730 |
| Pressure, atm | 1 to 10 | 1 to 5 | 3 to 4.5 |

-continued

| | Suitable | Preferred | Most Preferred |
|---|---|---|---|
| Air/Coke lb/lb | 5 to 25 | 10 to 20 | 12 to 17 |
| Stoichiometric Air Added, % | 50 to 120 | 75 to 110 | 80 to 105 |
| Average Catalyst Size, Microns | 30 to 200 | 40 to 100 | 50 to 80 |
| Recycled/Spent Catalyst | .05 to 2.0 | 0.1 to 1.0 | 0.15 to 0.7 |
| % Coke on Spent Catalyst | .2 to 2.0 | 0.3 to 1.5 | 0.3 to 1.0 |
| wt % Coke on Catalyst Leaving Combustor | 0 to 0.7 | 0.01 to 0.03 | 0.001 to 0.2 |

In dilute phase transport riser 24, the conditions are

| Conditions | Acceptable | Preferred | Most Preferred |
|---|---|---|---|
| Temperature, °C. | 590–925 | 650–760 | 660–730 |
| Density #/Ft$^3$ | 0.5–10 | 1–5 | 2–4 |
| g/cc | 0.008–0.16 | 0.016–0.080 | 0.032–0.064 |
| Catalyst Vertical Velocity | | | |
| fps | 0.5–20 | 0.5–15 | 0.56–10 |
| m/s | 0.15–6.0 | 0.15–4.5 | 0.15–3.0 |
| % CO Combustion | 50–100 | 70–100 | 90–100 |
| % Total Air Addition | 0–100 | 0–40 | 0–20 |
| % Coke on catalyst @ riser outlet | 0–0.7 | 0.01–0.3 | 0.01–0.2 |
| Mole % CO, inlet | 0–10 | 0–5 | 0–3 |
| Mole % C0, outlet | 0–5 | 0–3 | 0–2 |

In the dilute phase transport riser 24 a small amount of additional coke is removed from the catalyst, but that is not the primary purpose of transport riser 24. Preferably, enough additional air is added to the transport riser, or is present in gases leaving the coke combustor, to complete combustion of CO to $CO_2$ within the dilute phase of the transport riser. Ideally, enough CO combustion promoter is preferentially added to the dilute phase transport riser to rapidly convert all of the CO to $CO_2$ before the catalyst and gases exit the riser.

In prior art units, much CO would be afterburned to $CO_2$ within the transport riser, but severe oxidizing conditions existed in both the coke combustor and transport riser. In the present invention, severe oxidation conditions may be present in the transport riser and must be avoided in the coke combustor.

In the second dense bed 44, the conditions are

| Conditions | Acceptable | Preferred | Most Preferred |
|---|---|---|---|
| Temperature | 590–925 | 650–760 | 660–730 |
| Density #/FT$^3$ | 10–60 | 20–50 | 25–40 |
| g/cc | 0.16–0.96 | 0.32–0.80 | 0.64 |

Very little combustion occurs here, so little CO combustion or coke removal occurs. The second dense bed is a good place to clean up the FCC catalyst. There is almost no water of combustion, or residual steam from steam stripping, so little hydrothermal deactivation occurs. Most of the coke (and $NO_x$ precursors have already been removed, so severe regeneration conditions can be used to remove residual coke without forming much $NO_x$.

In the dilute phase above second dense bed 44, the conditions are

| Conditions | Acceptable | Preferred | Most Preferred |
|---|---|---|---|
| Temperature | 590–925 | 650–760 | 660–760 |

-continued

| Conditions | Acceptable | Preferred | Most Preferred |
|---|---|---|---|
| Mole % $O_2$ | 0–20 | 0–10 | 0–5 |
| % CO Combustion | 50–100 | 70–100 | 90–100 |
| Density #/FT$^3$ | 0.01–10 | 0.1–2 | 0.1–1 |
| g/cc | 0.00016–0.16 | 0.0016–0.032 | 0.0016–0.016 |

Although it is possible to operate with only a single cyclone separator discharging catalyst fines rich in CO combustion promoter into the dilute phase transport riser, operation with at least two stages of cyclones separation, as shown in the drawing, is preferred. Depending on plant conditions, it may be most cost efficient to allow the primary cyclone to discharge directly into the second dense bed 44, while the second stage cyclone discharged into dilute phase transport riser 24. Although not shown in the drawing, the diplegs of the cyclones discharging into the dilute phase transport riser 24 preferably have flapper valves, seal pots or other means which prevent reverse flow of gas of the diplegs of the cyclones. The diplegs also may discharge into catalyst distributors, such as trough and weir distributions to promote better mixing of promoter rich fines with CO rich gas in the dilute phase transport riser 24.

Although the cyclone diplegs discharge directly down into transport riser 24, in practice it may be easier to connect the diplegs to the sides or to transition section 25. Such an approach keeps the diplegs out of the severe erosive environment present in the fully developed dilute phase flow in the upper portions of the dilute phase transport riser, and minimizes to some extent the problems of back flow up the dipleg.

The FCC catalyst used is conventional.

The CO combustion promoter is not conventional. It floats. It may be concentrated in the catalyst fines. This means that either a relatively low density promoter, with the same or larger particle size than the FCC catalyst, is used or that a CO combustion promoter of smaller particle size is used. In the past, refiners avoided use of CO combustion promoter which congregated in the catalyst fines, as this would lead to relatively rapid loss of the expensive CO combustion promoter with catalyst fines.

FIG. 2 shows another embodiment of the present invention with preferential recycle of CO combustion promoter to the dilute phase transport riser 24. In FIG. 2, like elements have the same figure numerals in FIG. 1. In the FIG. 2 embodiment, conventional cyclones are used, but the CO combustion promoter is present as a relatively low density (floating) material which congregates in the upper portion 42 of dense bed 44. The floating CO combustion promoter is preferentially removed from the second dense bed via funnel 2, line 70, and flow control means 72 and discharged via line 74 into dilute phase transport riser 24, after which is passes up through the riser 24 to the top portion 30 of the riser.

Dense bed 14, within vessel 10, functions in the FIG. 2 embodiment as in the FIG. 1 embodiment.

The primary and second cyclones 52 and 50 respectively operate in a more conventional manner in that they merely return catalyst fines, and any floating CO combustion promoter present, to the second dense bed 44.

Preferably, the floating CO promoter is a relatively large size, strong, and light material which readily segregates to form a relatively low density dense bed 42, forming an interface 46 with relatively heavier dense bed 44.

The bulk physical properties of the preferred low density floating CO combustion promoter are Broad
- 0.1–0.7 g/cm$^3$
- 0.1–1.4 inch diameter
- 0.25–3.5 cm diameter Preferred
- 0.3–0.6 g/cm$^3$
- 0.25–1.0"0 diameter
- 0.75–2.5 cm diameter The embodiments shown in FIG. 1 and FIG. 2 can be merged to some extent by using a CO combustion promoter which congregates in the upper portion of a dense bed. Such promoters will also be found in relatively high concentration in catalyst fines present in cyclone dip legs. The inverse funnel 2 shown in FIG. 2 can be used to preferentially recycle the CO promoter-rich upper portion of the second dense bed to the transport riser, if the dip legs of at least some of the cyclones discharge into the inlet of funnel 2. The net effect will be preferential recycle of CO combustion promoter into the transport riser 24. This permits CO combustor 14 to operate relatively lean in CO combustion promoter, resulting in a reducing atmosphere in CO combustor 14. This promotes reduction of $NO_x$ formed in CO combustor 14 to nitrogen.

Although not shown in the drawing, reverse flow of CO promoter, from the top of the dense bed in combustor 14 to the top of the second dense bed, 42 is possible. An ivnerted funnel can be placed in the upper portion of combustor 14, to withdraw catalyst and CO promoter which can then be discharged, using a lift gas, into, or above, the second dense bed.

ILLUSTRATIVE EMBODIMENT

The following illustrative embodiment shows what results are expected when processing a feedstock in an FCC regenerator incorporating the improvements of either FIG. 1 or FIG. 2. The results shown are estimates based upon commercial data from a single dense bed FCC regenerator.

FEEDSTOCK PROPERTIES

20 °API
1600 ppm Nitrogen
650°–1000° F. nominal boiling range

FCC REACTOR CONDITIONS 5 second catalyst residence time
35 psig pressure
975° F. Top Temperature

REGENERATOR OPERATING CONDITIONS

Figure 3:
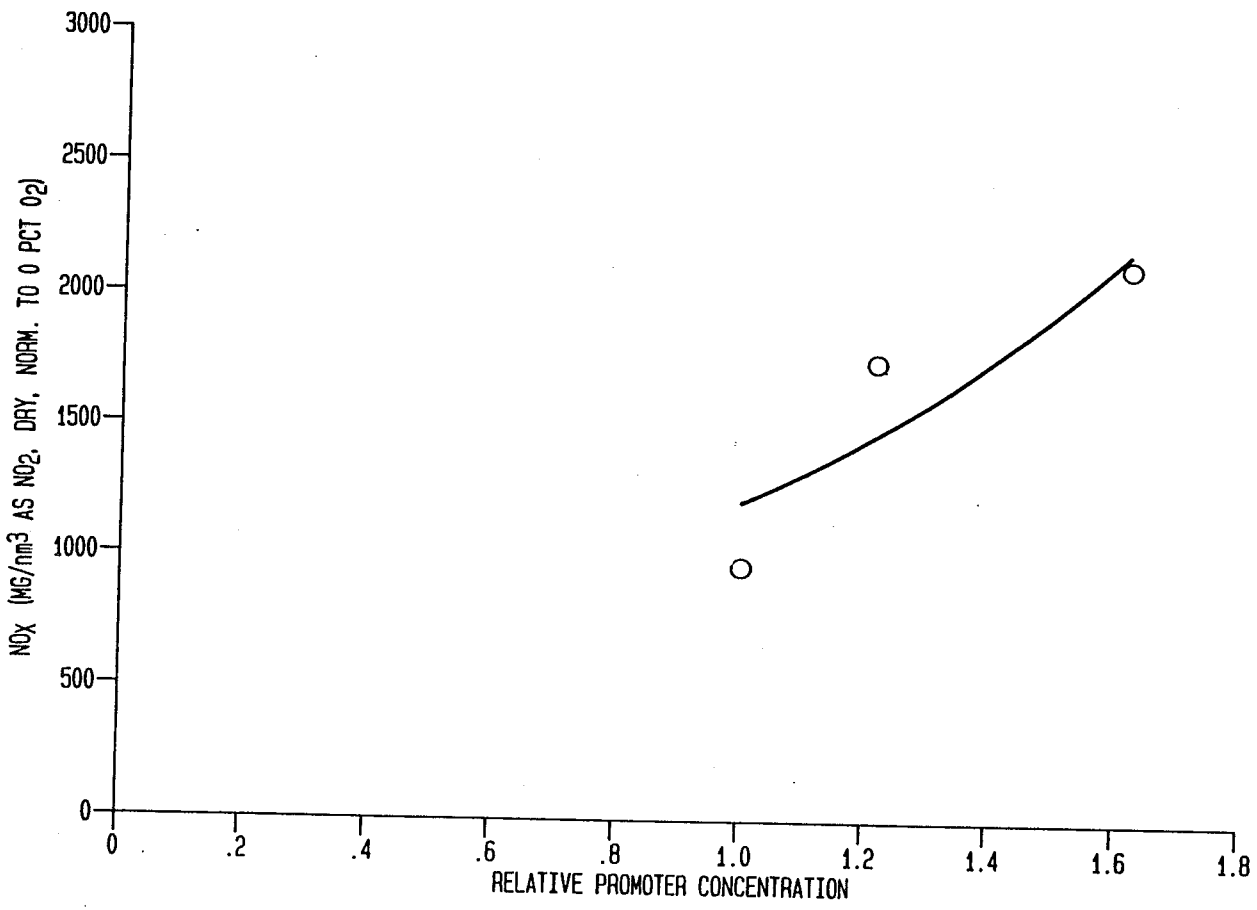
FIG. 3 shows how $NO_x$ emissions vary as a function of relative Pt level on FCC catalyst.

The FCC regenerator operated with a single dense bed having an average dense bed temperature of 1280° F. There was 1.0 volume % of $O_2$ in the regenerator flue gas. Tests were conducted in a commercial FCC unit, operating with a single dense bed of catalyst in the regenerator. The CO combustion catalyst was uniformly distributed within the regenerator. The flue gas contained 2100 mg/Nm$^3$ $NO_x$ and 70 ppm CO, with 7 ppm Pt on catalyst. Other tests were conducted with different levels of Pt to generate the data represented by FIG. 3. FIG. 3 shows how $NO_x$ content of the flue gas depends on Pt concentration in the dense bed.

By segregation the Pt in the top of the dense bed, the Pt content in the portion of the bed where the $NO_x$ is formed will approach 0 and, according to the graph, $NO_x$ emissions will decrease. For example, reducing the Pt content in the bottom of the bed from 7 ppm to 3 ppm will decrease $NO_x$ from 2100 mg/Nm$^3$ to 900 mg/Nm$^3$. This is much more Pt, and much more $NO_x$ than would typically be emitted from a minimum inventory FCC unit. The relative changes in $NO_x$ level with changes in Pt level are expected to be the same in both types of regenerators.

The CO combustion promoter is a Pt on alumina additive with the properties shown in Table II. These additives, and many more, are commercially available.

TABLE II

| Conventional Co Oxidation Promoters | A | B |
|---|---|---|
| Real Density, g/cc | 2.718 | 2.718 |
| Particle Density, g/cc | 1.597 | 1.619 |
| MSA Particle Size Distribution, % wt | | |
| 0–20 microns | 2.4 | 0.0 |
| 20–40 microns | 12.2 | 13.2 |
| 40–60 microns | 31.7 | 34.2 |
| 60–80 microns | 29.3 | 31.5 |
| 80+ microns | 24.4 | 21.1 |
| Average Particle Size, microns | 62.1 | 61.3 |
| Platinum Promoter Level, ppm | 101 | 431 |
| Co Oxidation Test | | |
| Promoter, g | 0.0240 | 0.0096 |
| Conventional catalyst, g | 19.9760 | 19.9904 |
| Platinum, ppm of mix | 0.121 | 0.207 |

Similar relative decreases in $NO_x$ emissions in a 2-stage or minimum inventory regenerator can be achieved when the promoter downstream of the combustor 14. By floating the promoter on top of the first dense bed in coke combustor 14, or recycling a promoter rich fines to transport riser 24, essentially complete CO combustion can still be achieved without exceeding temperature limits of the exit cyclones.

Preferential recycle of CO combustion-rich promoter to the dilute phase transport riser 24, without adjusting any other conditions in the FCC regenerator will not significantly change the regenerator operation, except to reduce $NO_x$ emissions. Essentially all of the heat from the CO combustion will be transferred to the catalyst so the heat balance in the unit will be the same.

Combustor 14 may be slightly cooler, when the Pt combustion promoter is in the recycled fines. A slight increase in recycle of hot regenerator catalyst to the coke combustor will counteract this.

Operation with preferential recycle of catalyst fines, via cyclone separation, to transport riser 24, coupled with a cutback in air addition to CO-combustor 14, and supplemental air addition to second dense bed 44 via lines 33, will significantly reduce $NO_x$ emissions.

By practicing the present invention, there will usually be a slight increase in CO combustion within the riser in the regenerator. This is because instead of trying to eliminate CO wherever it can be found in the regenerator, CO production is tolerated and indeed even encouraged in coke combustor 14. Addition of sufficient CO combustion promoter to transport riser 24 enables a refiner to burn substantially all of the CO to $CO_2$ within the transport riser before the catalyst is discharged to form second dense bed 44. Achieving substantially complete CO combustion within the transport riser minimizes afterburning in the dilute phase above dense bed 44.

The "minimum inventory" FCC regenerators as shown in FIG. 1 make less $NO_x$ than conventional single bed regenerators. These $NO_x$ emissions are significantly reduced by selective addition of CO combustion promoter to the dilute phase transport riser. Even further reductions are possible, where very low $NO_x$ emission limits must be met. This can be achieved by tolerating a significant amount of afterburning within the dilute phase space 84. Such afterburning will result in higher temperatures of the CO promoter-rich additive. This "super-heated" additive will be very efficient at promoting CO combustion within the dilute phase transport riser and will reduce slightly the average temperature of the FCC catalyst inventory in the regenerator. The benefits of this regime of operation are most apparent in reference to FIG. 2, i.e., CO combustor 14 could be operated with perhaps only 50 to 90% of the total air needed to completely burn all of the coke on the catalyst to carbon dioxide. Conditions in second dense bed 44, and the amount of air added to the second dense bed via line 33, may be adjusted so that the desired coke burn is obtained, while leaving a significant amount of CO present in the flue gas. This CO can be completely combusted to $CO_2$ in region 42, a region characterized by a dense bed of relatively low density floating particles containing CO combustion promoter. Complete CO combustion can occur here, resulting in very high temperatures which could be deleterious to normal FCC cracking catalyst but need not damage CO combustion catalyst. The heat of CO combustion would be transferred to the floating CO combustion promoter contained in dense bed 42, and this material recycled via Funnel 2 and line 70 and 74 into the dilute phase transport riser for heat recovery by direct contact heat exchange of floating particles with conventional FCC catalyst.

The operation discussed immediately above permits optimization of each part of the FCC regenerator. CO combustor 14 can be viewed as a carbon monoxide generator which removes most of the coke from the catalyst, but need not remove all of it. Completion of coke removal, and complete CO combustion, will usually occur in transport riser 24.

Second dense bed 44 can be used to remove the amount of coke from catalyst needed to achieve the desired coke level on regenerated catalyst, but need not achieve complete combustion of CO to $CO_2$. Floating dense bed 42, and to a lesser extent the dilute phase above it, may function to remove substantially all of the carbon monoxide from the flue gas. Conditions in bed 42, and in the dilute phase, can be optimized solely for maximum CO combustion. Conditions of very high temperature and high oxygen concentration can be easily tolerated as the floating CO combustion material need not have any FCC cracking activity, preferably it never gets to the FCC reactor. Other benefits flow from such an operation, namely, that the average temperature of the FCC catalyst inventory in the regenerator is decreased, and the time that the catalyst spends in a relatively steam rich atmosphere at high temperature is also reduced. This is because coke combustor 14 will form most of the $H_2O$ that is going to form in the regenerator at the lowest temperature in the regenerator. $H_2O$ of combustion formed in combustor 14 will not enter second dense bed 44. The temperature in second dense bed 44 will be higher than in combustor 14, but most of the hydrocarbonaceous coke will have been removed from the catalyst prior to its entry into dense bed 44, so further combustion occurring therein will not lead to formation of $H_2O$. This should lead to a significant increase in FCC catalyst life.

Another advantage of the process of the present invention is that is provides refiners for the first time with the opportunity to selectively promote, or hinder, coke combustion and CO afterburning in several placed in the FCC regenerator. If $NO_x$ emissions are not a problem then coke combustion and CO afterburning may be optimized by adding excess air to the coke combustor 14. If $NO_x$ emissions are a severe problem, coke combustion in combustor 14 can be restricted to perhaps 50% of normal, creating a CO rich reducing atmosphere which will aid in minimizing $NO_x$ emissions. Coke combustion can be completed in the transport riser or even in the second dense bed.

The very gentle regeneration possible with three stages of coke removal also minimizes local overheating on catalyst particles, and also reduces the average catalyst temperature.

I claim:

1. In a Fluidized Catalytic Cracking (FCC) process wherein conventional FCC catalyst contacts conventional FCC feedstocks in a conventional FCC reactor to produce cracked products and coked catalyst which is regenerated in a conventional regenerator comprising a first dense bed coke combustor to which air or an oxygen-containing gas is added to produce at least partially regenerated catalyst and combustion gas which rise from the first dense bed and through a dilute phase transport riser to form a second dense bed of regenerated catalyst and flue gas, and the regenerated catalyst is recycled to the FCC reactor, the improvement comprising reducing $NO_x$ emissions and achieving substantially complete carbon monoxide combustion by selective addition of a carbon monoxide (CO) combustion promoter to the dilute phase transport riser, such that there is a greater concentration of said combustion promoter in the dilute phase transport riser than in the first dense bed and wherein after passing through said dilute phase transport riser combustion promoter is recycled to said dilute phase transport riser.

2. The process of claim 1 wherein the flue gas is at least periodically tested for $NO_x$ content and the amount of CO combustion promoter added to the transport riser is controlled to minimize the $NO_x$ content of the flue gas.

3. The process of claim 1 wherein the CO combustion promoter is readily entrainable in the flue gas and is recovered from the flue gas and recycled therefrom to the regenerator at a point below a midpoint of the dilute phase transport riser.

4. The process of claim 3 wherein cyclone separators recover CO combustion promoter from the flue gas.

5. The process of claim 1 wherein the CO combustion promoter is supported on particles with a diameter at least 10 times the average catalyst diameter and with a bulk density less than that of the catalyst.

6. The process of claim 1 wherein the CO combustion promoter is maintained as a relatively less dense dense bed above the second dense bed, and CO combustion promoter withdrawn from the relatively less dense bed and is recycled to the regenerator at a location below the midpoint of the dilute phase transport riser.

7. The process of claim 1 wherein the CO combustion promoter comprises 0.01–100 wt.ppm of a Pt group metal or combination thereof, calculated on the basis of the total catalyst inventory.

8. The process of claim 1 wherein a reducing atmosphere is maintained in the coke combustor.

9. The process of claim 8 wherein addition of air or oxygen containing gas added to the first dense bed is restricted to create a reducing atmosphere which minimizes formation of nitrogen oxides ($NO_x$).

10. The process of claim 1 wherein air or oxygen-containing gas is added to the dilute phase transport riser.

11. The process of claim 1 wherein air or oxygen containing gas is added to the second dense bed.

12. The process of claim 1 wherein a portion of the regenerated catalyst from the second dense bed is recycled to the first dense bed.

* * * * *

UNITED STATES PATENT AND TRADEMARK OFFICE

CERTIFICATE OF CORRECTION

PATENT NO. : 4,812,430

DATED : March 14, 1989

INVENTOR(S) : Jonathan E. Child

It is certified that error appears in the above-identified patent and that said Letters Patent is hereby corrected as shown below:

| | |
|---|---|
| Col. 2, line 16 | delete "," and insert --.-- |
| Col. 2, line 59 | delete "catalystically" and insert --catalytically |
| Col. 5, line 44 | delete "tend" and insert --tends-- |
| Col. 6, line 3 | delete the second occurrence of "as" and insert --a-- |
| Col. 8, line 29 | delete "COhd 2" and insert --$CO_2$-- |
| Col. 8, line 35 | delete "after burning" and insert --afterburning-- |
| Col. 10, line 50 | delete "numerals" and insert --number as-- |
| Col. 10, line 58 | delete "is" and insert --it-- |
| Col. 14, line 5 | after "that" delete "is" and insert --it-- |

Signed and Sealed this

Twenty-eighth Day of November 1989

*Attest:*

JEFFREY M. SAMUELS

*Attesting Officer* *Acting Commissioner of Patents and Trademarks*